United States Patent [19]

Buchan et al.

[11] Patent Number: 4,623,241

[45] Date of Patent: Nov. 18, 1986

[54] DEVELOPING APPARATUS AND METHOD FOR A PHOTOCOPIER EMPLOYING LIQUID DEVELOPMENT

[75] Inventors: William R. Buchan, Pepperell, Mass.; Jerome R. Faucher; John M. Cosby, both of Nashua, N.H.

[73] Assignee: Nashua Corporation, Nashua, N.H.

[21] Appl. No.: 524,099

[22] Filed: Jul. 18, 1983

Related U.S. Application Data

[63] Continuation of PCT US81/01531, Nov. 18, 1981, Published as WO83/01843, May 26, 1983.

[51] Int. Cl.[4] ..... G03G 15/10; G03G 15/06; G03G 9/08

[52] U.S. Cl. ..... 355/10; 118/647; 430/117

[58] Field of Search ..... 355/10, 14 D; 430/117-119; 118/647-651, 659-662; 210/172, 496, 510.1; 354/317

[56] References Cited

U.S. PATENT DOCUMENTS

| | | | |
|---|---|---|---|
| 2,587,350 | 2/1952 | Maiwald | 95/94 |
| 2,752,833 | 7/1956 | Jacob | 95/1.7 |
| 3,081,687 | 3/1963 | Takats | 95/89 |
| 3,162,104 | 12/1964 | Medley | 95/1.7 |
| 3,176,653 | 4/1965 | Hansen | 118/637 |
| 3,196,832 | 7/1965 | Zin | 118/637 |
| 3,371,651 | 3/1968 | Johnson et al. | 118/637 |
| 3,407,786 | 10/1968 | Beyer et al. | 118/637 |
| 3,507,252 | 4/1970 | Leedom | 118/637 |
| 3,608,523 | 9/1971 | Jeffery et al. | 118/637 |
| 3,758,204 | 9/1973 | Mochizuki | 355/10 |
| 3,791,345 | 2/1974 | McCutcheon | 118/637 |
| 3,831,556 | 8/1974 | Sato et al. | 355/10 X |
| 3,876,448 | 4/1975 | Savit et al. | 355/10 |
| 3,878,817 | 4/1975 | Kuehnle | 118/637 |
| 3,929,099 | 12/1975 | Szymber et al. | 118/637 |
| 3,943,268 | 3/1976 | Sato | 427/17 |
| 3,957,368 | 5/1976 | Goshima et al. | 355/8 |
| 4,013,356 | 3/1977 | Bestenreiner et al. | 355/10 |
| 4,179,210 | 12/1979 | Bestenreiner et al. | 118/647 X |
| 4,193,683 | 3/1980 | Langer | 355/10 |
| 4,236,483 | 12/1980 | Davis et al. | 355/10 X |

*Primary Examiner*—Arthur T. Grimley
*Assistant Examiner*—C. Romano

[57] ABSTRACT

A development apparatus and method positions the development electrode (30), in a liquid development system, in a close, spaced apart relationship to a moving photosensitive surface (12). The development electrode (30) has plural supply conduits (76) and at least one drain conduit (84) for eliminating toner starvation during the development process. The development apparatus and method further employ a pressurized filter element (50) having a cell size larger than the particle size to be trapped for reducing the occurrence of voids on the output copy. The filter (50) is configured to provide, in its sealed housing, input (80) and output (82) manifolds.

4 Claims, 15 Drawing Figures

DEVELOPING APPARATUS AND METHOD FOR A PHOTOCOPIER EMPLOYING LIQUID DEVELOPMENT

The invention relates generally to liquid developer photocopying apparatus and methods and in particular to apparatus and methods for improving the developing station of a liquid developer photocopier for improving copy quality.

BACKGROUND OF THE INVENTION

The liquid development system employs a moving photosensitive surface which is uniformly charged electrically and subsequently is exposed to a pattern of electromagnetic energy, usually in the visible wavelength, reflected from an original document. There is thus formed on the photosensitive surface a latent electrostatic image. That image is then developed using a liquid developer having toner particles in a liquid carrier. The toner particles are attracted to the latent image under the influence of the electrical charge pattern, in combination with a development electrode. The developed image is thereafter transferred onto a copy medium. The photosensitive surface is then cleaned and prepared for its next use.

Various efforts have been made to improve the development process and the "completeness" of transfer to improve image density on the copy medium. These two process areas appear to be very important in obtaining high image density copies, especially when "bond" papers are employed. Generally speaking, bond paper has a relatively coarse surface, that is, relatively deep "holes" with a relatively small openings. Efforts have been made to improve the liquid development process in general, and in particular to improve the capability of liquid development with respect to "bond" paper.

The technological improvements have been directed for example to improving the liquid developer (see U.S. application Ser. No. 109,393, filed Jan. 3, 1980), the transfer process (see copending application Ser. No. 316,273, filed Oct. 29, 1981), and to improvements in the development station (see for example U.S. applications Ser. Nos. 282,223, 282,224, and 282,225, filed July 10, 1981). While these efforts have been successful to a limited extent, there still remains further "room for improvement".

It is therefore an object of the present invention to provide an improved method and apparatus at the development station of a liquid developer photocopying system for improving the density and resolution of the developed image and in particular the image copy quality provided by the apparatus. Other objects of the invention are a method and apparatus for use at the development station which are reliable, low in cost, and simple in construction. Another object of the invention is a method and apparatus which provide greater control over the many parameters, associated with the development station, which can affect machine operation and copy quality.

SUMMARY OF THE INVENTION

The invention relates to a development apparatus and method for use with a photocopier having (a) an exposure station for forming a latent electrostatic image on a photosensitive surface, (b) a development station for visualizing the latent image using a liquid developer system, and (c) a transfer station for transferring the visualized image from the photosensitive surface to a copy medium. The development apparatus, at the development station, has a development electrode. The development electrode has a fluid directing surface in a spaced apart relationship to the photosensitive surface at the development station. The fluid directing surface has a plurality of electrically conductive and nonconductive surface portions.

In one aspect, the development apparatus features a liquid developer supply for supplying the developer to the space between the photosensitive surface and the fluid directing surface at a plurality of spaced apart fluid supply locations, the locations being spaced apart along the electrode in the direction of movement of the photosensitive surface. The apparatus further features liquid removal elements for removing the liquid developer from the space between the photosensitive surface and the fluid directing surface at one or more fluid removal locations, these locations being also spaced apart along the electrode in the direction of movement of the photosensitive surface. Each of the fluid removal locations is arranged to remove liquid supplied by at least one fluid supply location.

This structure provides, at the development station, a continual supply of "fresh" liquid developer along the length (in the direction of photosensitive surface movement) of the electrode and, in combination with the electrically conductive region(s) of the fluid directing surface provides an advantageous structure for enhancing and/or controlling toner densities.

In another aspect, the development apparatus features a filter block positioned within the developer tank. The filter block has an open cell foam structure wherein the average "passage" size is larger than the particle size of the toner in the liquid developer passing therethrough. Preferably, in this aspect of the invention, a pump is provided for pumping the liquid developer from an open free liquid portion of the developer tank to and through the developer filter element.

BRIEF DESCRIPTION OF THE DRAWINGS

Other objects, features, and advantages of the invention will appear from the following description of a preferred embodiment taken together with the drawings in which.

DESCRIPTION OF THE PREFERRED EMBODIMENT

Figure 1:
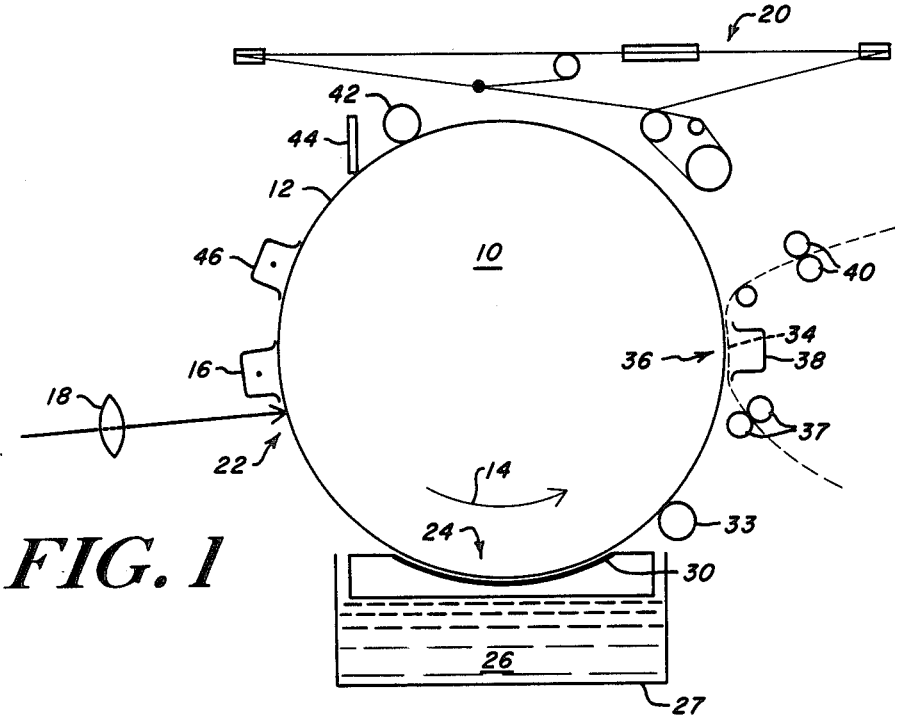
FIG. 1 is a schematic elevation view of a photocopier in the invention can be incorporated.

Referring to FIG. 1, a liquid developer photocopier 8 has a photosensitive element, for example a drum 10 having a photosensitive selenium surface 12 deposited on an aluminum substrate. The drum 10 rotates in a counterclockwise direction as indicated by an arrow 14. A plurality of process stations are arranged around the circumference of the drum.

A charge corona 16 uniformly charges the drum to about 1,000 volts DC. The thus charged drum 10 is exposed to an image typically projected by a lens system 18 from the object plane of a scanning system 20. The image is focused on the drum photosensitive surface 12 at an exposure station 22. As a result, the charge on the drum surface is selectively removed (or discharged) and an electrostatic latent image having a pattern of charged and non-charged areas is thus formed on the surface. The latent electrostatic image on the drum photosensitive surface 12 rotates to a development station 24 where a liquid developer 26 contained in a tank 27 is drawn from and contacts the electrostatic image to develop or visualize the image. Typically, where the drum charge is positive, the liquid developer has a negatively charged toner.

The developer liquid 26 is pumped from the developer tank assembly 27 to the space between a development electrode 30 and the photosensitive surface 12. As described in more detail below, the liquid developer is introduced, in the illustrated embodiment, into the space or "gap" at a plurality of positions or locations spaced apart in the direction of drum surface movement. The liquid developer acts to develop the latent image on the drum surface and in the process "wets" the drum surface.

The drum surface 12, now carrying the developed image as well as an excess layer of developer liquid, rotates past a metering roll 33 of the development station. The metering roll, operating as is well known in the art, limits the thickness of the liquid film or layer on the drum photosensitive surface 12. Thereafter, a transfer material 34, preferably a copy sheet, is directed to the drum surface in synchronism with the advancing, now developed, image and meets the developed image at a transfer station 36. The paper feeding apparatus includes a plurality of rollers 37 which operate in timed relation to the drum surface movement to properly feed the paper toward the drum.

The transfer station 36 includes a transfer corona 38 which applies a positive charge to the side of the sheet material 34 not in contact with the drum, for helping to effect transfer of the toner particles from the drum surface 12 to the contacting side of the copy sheet 34. The copy sheet is then removed from the drum surface and follows an exit path, for example through a set of rollers 40.

After transfer, there generally remains on the drum surface a residue of liquid developer due to incomplete transfer. This residue is cleaned from the drum surface by a cleaning roller 42 and a cleaning blade 44. The drum surface is next electrically neutralized or discharged to ready it for its next use. Discharge is effected, in the illustrated embodiment, by a high voltage AC corona 46.

Figure 2:
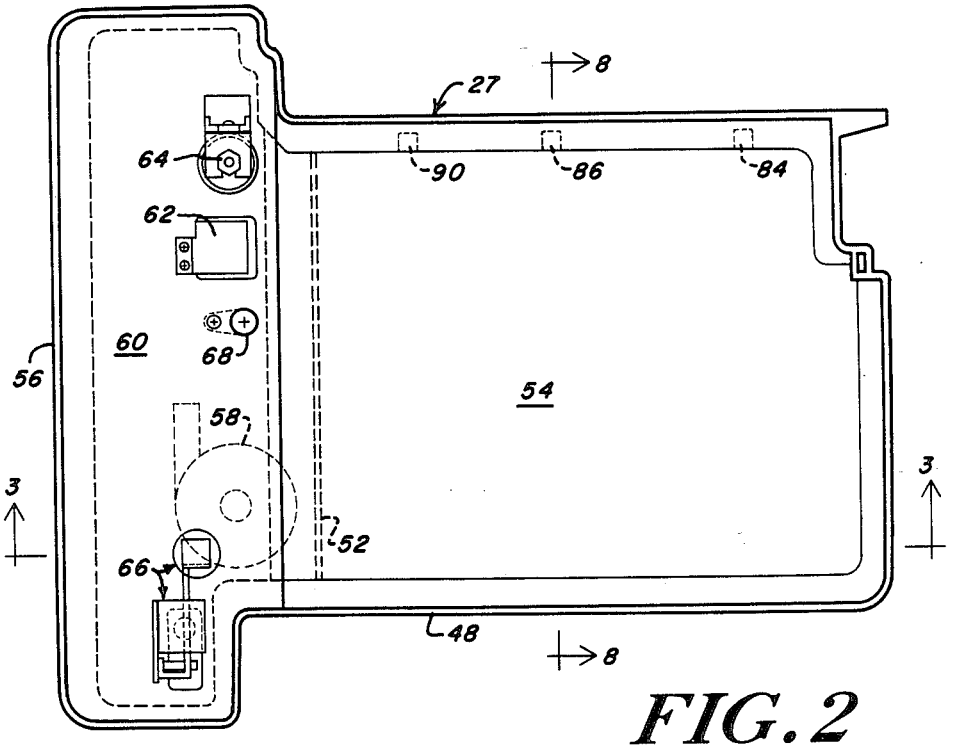
FIG. 2 is a top plan view of the developer tank according to the invention.
Figure 3:
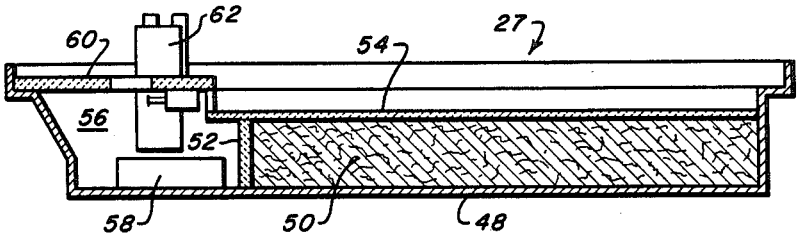
FIG. 3 is a cross-section along lines 3—3 of FIG. 2.

Referring to FIGS. 2 and 3, the development station tank 27 has a laterally extending filter section 48 which extends beneath the entire width of the photosensitive surface and the development electrode at the development station 24. Lateral section 48 contains therein a filter element 50 described in more detail below. Element 50 is sealingly contained within a filter element housing bounded by the tank outer wall, a side plate 52 and a sloping top plate 54. The top plate 54 is pitched to direct liquid developer impinging thereon from the upper portions of the development station toward a free liquid volume section 56 of tank 27, and in particular toward that portion of section 56 having a pump member 58. The pump member 58 pumps liquid to the gap between the development electrode and the photosensitive surface and to the cleaning station by way of the filter element 50 as described in detail below. The pump element is housed within the liquid developer.

A plate 60 covers the free liquid volume section 56 and supports a toner density probe 62, a fluid level probe 64, and a toner addition assembly 66. Also, referring to FIG. 2, an outlet 68 is provided for directing fluid to the cleaning station.

Figure 7:
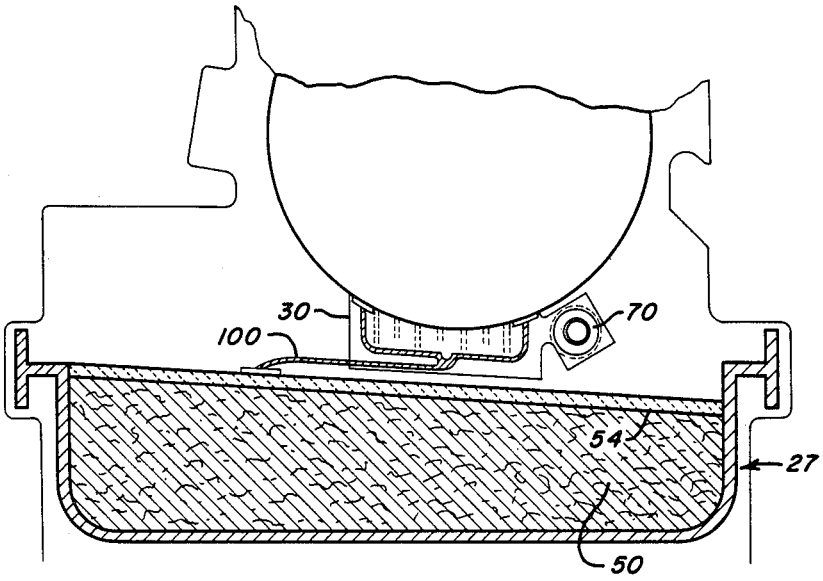
FIG. 7 is a cross-sectional view showing the relationship of the metering roll and development electrode in accordance with the invention.

Referring to FIG. 7, the development electrode is positioned above the developer tank. The development electrode is mounted in a close, spaced-apart configuration relative to the photosensitive surface of the drum. A support bearing arrangement for a counterrotating metering roll 33 is secured in a fixed position relative to the development electrode and attached thereto. As is described, for example, in U.S. Pat. No. 4,236,483, the metering roll 33 acts to limit and control the thickness of the film which remains on the photosensitive surface after the development process.

Figure 4A:
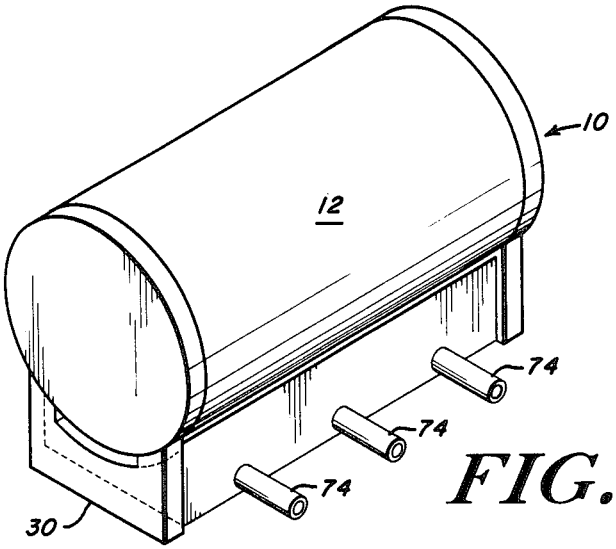
FIG. 4A is a simplified perspective view of a development electrode assembly showing plural developer inlets.
Figure 4:
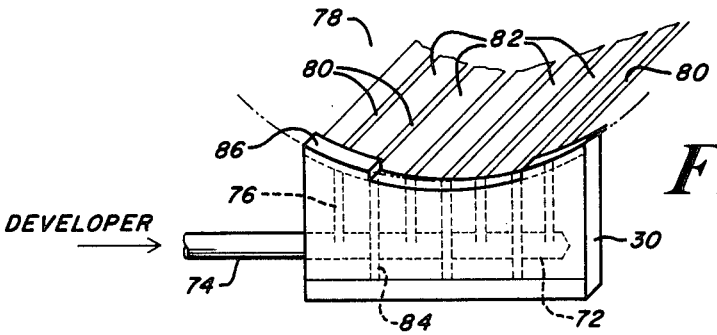
FIG. 4 is an exaggerated sectional view of the development electrode and the manifolds supplying and removing liquid therefrom.

Referring to FIG. 4, there is shown in greater detail the structure of the development electrode 30. In accordance with the preferred embodiment of the invention, the development electrode is molded out of a block of insulating material such as, for example, lexan, in which central feed manifolds 72 are formed. Fluid is supplied to manifolds 72 through tubes 74 from the toner tank 27. At a plurality of locations along each manifold 72, there are connecting conduits 76 which terminate in slots 80 extending across the fluid directing surface 78 of the development electrode 30. As shown in FIG. 4A, developer is provided at a plurality of locations spaced transverse to the direction of photosensitive surface movement to ensure a uniform distribution of developer flow across the entire photosensitive surface.

Still referring to FIG. 4, the slots 80 are spaced apart along the fluid directing surface in the direction of movement of the photosensitive surface. In the illustrated embodiment there is provided between each of the fluid supply slots a fluid removal slot 82. The fluid removal slots, like their counterpart fluid supply slots, are spaced at locations along the development electrode in the direction of the photosensitive surface movement. The slots 82 allow "used" developer to leave the space between the development electrode and the photosensitive surface by passing into and through slot connecting conduits 84. The output end of the conduits 84 are open in the illustrated embodiment and the "used" developer falls onto the upper surface of plate 54 of the developer tank 27 and is directed thereon to a corner of the tank as determined by the direction of pitch of plate 54. (Alternately, the tube members 84 could be connected to a manifold for directing the fluid to a predetermined location.) Slots 82 thus remove liquid supplied by one or more of the slots 80 positioned upstream thereof.

The development electrode 30 is spaced apart from the photosensitive surface, for the reasons discussed below, by a very small distance, on the order of 0.010". Consequently, it is important to properly and precisely control the spacing between the photosensitive surface and the fluid directing surface 78 of electrode 30. In order to accomplish this, distance controlling members, such as shoes 86, similar to those described in connection with U.S. Pat. No. 4,236,483, are employed to provide a four-point contact with the photosensitive surface along outside edges thereof. The shoes, as disclosed in the above-referenced patent, can be constructed of any of a number of suitable, long wearing materials such as delrin or penlon. Preferably, the shoes are cut out so that the eccentricity or run out of the drum does not adversely affect the "gap" setting. There is thus provided a development station structure for precisely controlling the spacing between the development electrode and the photosensitive surface, for ensuring that "fresh" toner is constantly applied to the gap volume, and wherein the "used" developer liquid is effectively directed to the developer tank.

The importance of maintaining adequate control over the constituency and use of liquid developer, cannot be overstressed.

As the photosensitive surface 12 of drum 10 is rotated to develop the latent electrostatic image thereon, toner particles, in the gap between the fluid directing surface 78 and the photosensitive surface, will respond to two primary forces. These are the electrostatic force due to the field set up between the latent electrostatic image and the development electrode, and the force corresponding to the viscous drag of the fluid. In the middle of a large solid area being developed, the electric field is relatively constant so that the electrostatic force, $F_1$, is constant.

$$F_1 = qE \qquad \text{Equation 1}$$

where q is the toner particle charge and E is the electric field. The force, $F_2$, due to viscous drag, is proportional to the toner particle velocity v:

$$F_2 = -Kv \qquad \text{Equation 2}$$

where K is a constant.

During development, toner particles are therefore accelerated to a velocity v at which the force due to viscous drag is equal to but opposite in direction from the electrostatic force. Thus, $$F_1 = -F_2 \qquad \text{Equation 3a}$$

$$qE = K\,v \qquad \text{Equation 3b}$$

$$v = \frac{q}{K} E \qquad \text{Equation 3c}$$

that is, toner particle velocity increases to a steady state velocity which is proportional to the electric field. The incremental mass of toner per unit area dM, developed on a solid area is that contained in a cylinder of unit cross-sectional area and length vdt where dt is an increment of time available for image development. Thus, $$dM = C\,v\,dt \qquad \text{Equation 4a}$$

$$= \frac{Cq}{K} E\,dt \qquad \text{Equation 4b}$$

-continued $$M = \frac{Cq}{K} \int_0^T E\,dt \qquad \text{Equation 4c}$$

where C is the toner concentration, M is the total mass of toner on a unit area developed in time T. Equation 4c takes account of the decrease in electric field with time due to toner charge which attaches to the electrostatic latent image thereby counterbalancing the image charge. To a first approximation, the integral in Equation 4c will be equal to the average field, $\overline{E}$, over the time T, and E will be proportional to the initial field $E_o$. Thus, $$\int_0^T E\,dt = \overline{E}T = K_1 E_o T \qquad \text{Equation 5a}$$

Thus:

$$M = \frac{Cq}{K_2} E_o T \qquad \text{Equation 5b}$$

Finally, $T = \frac{L}{u}$ where

L = length of the development electrode in the direction of motion u = relative velocity of the electrode and photoconductor; and $E_o = V_o/d$ where $V_o$ = initial charging potential of photoconductor d = distance separating photoconductor and development electrode $$\text{Hence, } M = \frac{q}{K_2} C \frac{V_o L}{ud} \qquad \text{Equation 6}$$

In Equation 6, the first term includes parameters of the liquid developer such as the charge to mass ratio of the toner particles and the viscosity of the fluid. Since $K_2$ is a function of q and T, more toner will not necessarily adhere to the photosensitive surface as q is increased. The second and third terms are process parameters which may be varied for a particular toner to achieve a particular result.

Equation 6 assumes that the toner particles are rapidly accelerated to a velocity at which the electrostatic and viscous forces balance each other, and that there is always available enough toner for image development, that is, there is no image starvation. It is found possible to make Equation 6 true for the conditions which are found in a liquid toner electrophotographic copier. For example, reducing both L and d by a factor of 3, L from say 3" to 1" and d from say 0.030" to 0.010", gives identical copy density in solid areas and hence identical values of M in those areas. Also, by reducing d by a factor of 3, but reducing L to only $\frac{2}{3}$ of its original value provides greater copier density in the solid areas. The latter result is of particular value since it demonstrates that it is possible to obtain higher copy density with a smaller development electrode while other conditions such as machine speed and toner concentration remain unchanged. Other useful tradeoffs among the parameters of Equation 6 are possible.

In order to obtain these results, it is necessary to accurately control the spacing d between the development electrode 30 and the photocopier surface 2. That is, the spacing d has to be maintained at a constant value. This is accomplished by using the shoes 86 to support the electrode as shown in the figures. The shoes are relieved in a central region thereof to accommodate any variations in the drum diameter with a minimal effect on the spacing. High density polyethylene and nylons are suitable shoe materials. Other long life materials can also be used.

It is also necessary to avoid toner starvation when achieving the results indicated above. This is effectively implemented by providing the toner at a plurality of locations, slots 80, to the gap between the electrode surface and the photosensitive surface. Toner starvation is further importantly avoided by draining developer from the gap at a plurality of locations, slots 82. As noted above, each illustrated feed slot is connected to a number of inlets in order to ensure uniformity of supply. In practice, it is found that a spacing of about 0.5" between the drain and feed slots is adequate to avoid toner starvation. In the illustrated embodiment, the drain and feed slots are each 1/16" in width.

Thus, the reduced gap between the development electrode and the photosensitive surface 12 enables a reduced length development electrode to be employed. In addition, and unexpectedly, halo, an image defect commonly found to occur with liquid developers and consisting of a ring of deposited toner surrounding, but separated from, a solid image area, is also found to be reduced or absent. This is true even under conditions which would otherwise generally promote it, that is, for example when operating at an elevated developer temperature and at high developer usage.

Figure 5A:
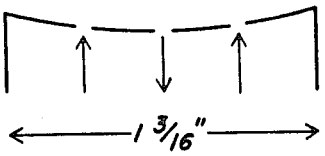
FIGS. 5A and 5B are end views of two configurations of a development electrode.
Figure 5B:
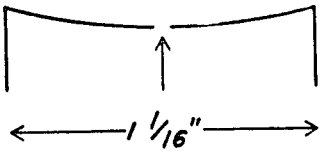

The development electrode can also be advantageously configured to increase the resolution or acuity of developed areas. When the problem of toner starvation was addressed, experiments using electrodes having a constant length, L, but with varied spacing between toner supply and drain slots were employed. As the spacing between toner supply slots was increased, and the number of slots reduced, it was found that higher image resolution is obtained when the spacing between supply slots was reduced. For example, the electrode of FIG. 5A, with three slots and an overall length of 1¾", gives better resolution than the electrode of FIG. 5B with one slot and an overall length of 1 1/16". The copy density in the solid areas was identical with either electrode structure. The apparent cause of this effect is that the solid areas are developed with toner only while they lie opposite a conductive region of the development electrode. The localized image areas and edges however develop with toner even in the absence of a conductive electrode due to the much more intense electric field associated with them. The structure of FIG. 5A therefore provides greater development time for localized areas and edges, relative to that of FIG. 5B, while providing the same development time for solid areas. Further, it is not known whether other factors, such as the supply of fresh developer liquid at the feed slots acting as a non-electrode area, or the presence of sharp electrode edges at the slots to enhance the electric field are significant. It is clear however that the feed and drain slots can be used to advantage for enhancing copy resolution.

Thus far, it has been assumed that the development electrode is fully conductive, except where the fluid supply and drain slots are provided. This, however, need not be the electrode configuration. Assuming that the major causes of resolution enhancement are relative development time and field enhancement by edges, as outlined above, then the enhancement can be obtained without incurring the complexity of more feed and drain slots than are required to avoid toner starvation. Instead of feed and drain slots to reduce the electrode conductive area, areas of dielectric are used. (The end(s) of the electrode can thus function as a drain "slot" as, for example, in FIG. 5A.) This may be obtained from a laminated structure of metal and dielectric, for example, by applying a conductive coating to a dielectric base. It is not necessary that any particular pattern of conductive and dielectric material be used, so that many patterns such as those of FIG. 6A–6F could be used. What is important, is that an adequate solid area development be maintained. This can be ensured by adapting the pattern to provide a sufficient electrical capacitance between the electrode and the photoconductor. Also, the gaps in the conductive pattern must be larger than the localized areas to be subjected to enhanced development.

Figure 6A:
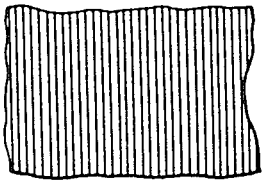
FIGS. 6A–6F are top views of various configurations of development electrode pattern in accordance with the invention.
Figure 6B:
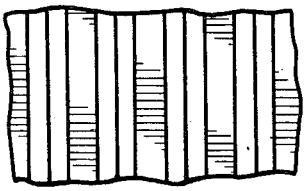
Figure 6C:
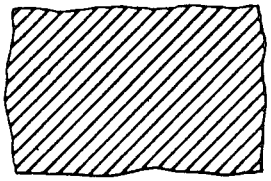
Figure 6D:
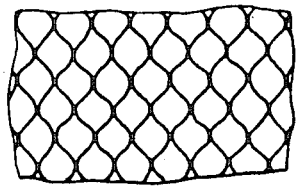
Figure 6E:
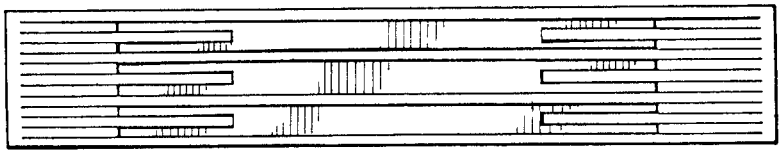

The above considerations also assume that uniform development is desired across the width W of the photoconductor. However, this may not always be the case. For example, optical systems used for exposing photoconductors generally exhibit some vignetting, or reduced exposure at the edges. This is especially true of less expensive optics. The result is a higher background voltage and toner deposition at the edges of the photoconductor. By adapting the pattern of conductive material in an electrode, it is possible to design an electrode with reduced solid area development at the edges, which, however, maintains adequate development of localized areas at the edges. This is because the background density depends on the capability for solid area development, while the density of typical image areas such as print depends on the capability for localized area development. Thus, ratio of dielectric surface to conductive surface is increased progressively in going from the center to either edge of the electrode, for example by increasing the number and/or width of dielectric strips towards the edges as shown in FIG. 6E (the conductive surface portion being represented by the black areas). In many cases this electrode would allow less expensive optics to be used in a low cost copier without obtrusive loss of copy quality.

Figure 6F:
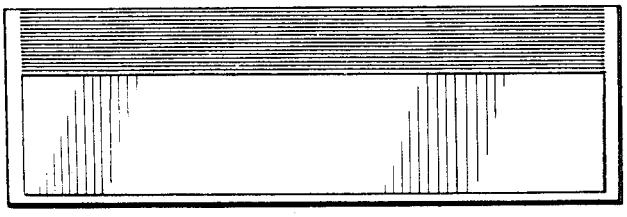

Another useful conductive pattern is shown in FIG. 6F. In this case, the photoconductor bearing a charge image passes first under a set of fine interconnected conductive lines as the electrode. It then passes under an electrode area which is continuously conducting. The function of this arrangement is to form the initial toner deposit preferentially on fine structure of the charge image. By reducing the net charge on the fine image structure, the initial toner deposit reduces the rate at which toner is subsequently developed on the fine structure. This avoids loss of resolution in developing fine image structure due to deposition of excessive amounts of toner. The line width and spacing may be chosen to enhance the development of limiting resolution elements in the charge image. For example, conductive lines 0.005 in. wide spaced at 0.025 in. center to center, located 0.010 in. from the photoconductor surface will enhance the initial development of 0.005 in. image elements. The other conductive patterns (FIGS. 6A–6D) provide further examples of conductive surface structure generally separated by a non-contiguous, non-conductive surface structure and adapted to the photocopier for improving image quality.

As noted above, the development tank contains a filter element 50 which, as shown in the illustrated embodiment, fills substantially 80% of the development tank volume. The filter has large openings, openings much larger than the particles to be trapped, and is effective in reducing the area density of "voids" in copies (voids are caused generally by large particles in the image material interfering with toner transfer to the paper, etc.). Such filters appear to depend on reduced particle mobility, relative to liquid mobility, through the volume of the filter. The effect is thus due to particles which collide within the filter structure. The reduced mobility results in elevated concentrations of large particles within the volume of the filter and a lower particle concentration in the free liquid volume 56. Maximum effect is then obtained by maximizing the ratio of the filter volume to the free liquid volume. The greater part of the illustrated tank volume is therefore devoted to the filter, and this is conveniently located under the inclined surface, top 54, for collection of the liquid developer. A limited free liquid volume is thus left at the front of the tank for accommodating pumps, sensors, and other mechanisms as noted above. This is convenient for service, and minimizes spillage when moving the tank.

Figure 8:
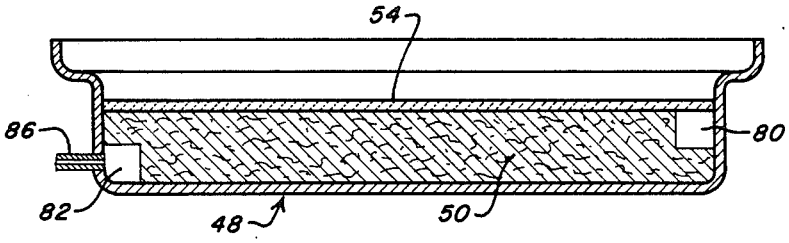
FIG. 8 is a cross-sectional view along lines 8—8 of FIG. 2.

Plastic foam made of urethane with pore sizes of 0.005" to 0.020" is suitable as the filter medium. FIG. 8 shows a cross-sectional view of the filter under the sloping collection plate 54. The filter is fed from the pump outlet and is therefore "pressurized". The filter is cut away at a top edge 80 to provide free flow of liquid across the length of the filter. This cut away section thus acts like an inlet manifold. Similarly, the illustrated filter is cut away at an opposite bottom edge 82 whereby an outlet manifold is effectively provided. Outlets 84, 86, and 90 provide liquid developer to the several manifolds 72 of the development electrode. A separately constructed manifold at the pump is not needed.

The inclined plate 54 for collecting effluent also serves to mount the spring 100 used to support the electrode/roller/shoes assembly. Basically, the spring comprises a bifurcated structure for resiliently urging each of the shoes against the photosensitive surface.

There is thus described an advantageous structure for improving the efficiency of operation and the quality of the output from a liquid photocopier, and in particular for improving the development station of the copier.

SUMMARY OF THE ADVANTAGES AND NON-OBVIOUSNESS OF THE INVENTION

Liquid toner apparatus, according to the invention, thus operates with a more precisely controlled development station configuration. The distance between the development electrode and the photosensitive surface is advantageously controlled and decreased, evaporation from the copier is reduced due to the construction of the covering plate, and a convenient and reliable construction can be achieved.

The invention provides for better image density and copy quality than that available with prior art systems. The use of toner removal slots and cleaning of the filter element advantageously provide a reliable development system.

While some aspects of the invention can be found separately in various of the prior art references, for example, U.S. Pat. Nos. 3,892,481; 4,021,111; and 4,286,039, the claimed invention, and the embodiments illustrated herein are neither shown nor suggested by the prior art references.

Additions, subtractions, deletions, and other modifications of the preferred and illustrated embodiment, would be obvious to those practiced in the art and are within the terms of the following claims.

What is claimed is:

1. In a development apparatus for visualizing a latent image on a photosensitive surface using a liquid developer, said apparatus having a development electrode, a developer tank containing a supply of liquid developer, a pump means for pumping liquid developer from the tank at least to the development electrode, a filter means positioned within the developer tank, means for mounting the developer tank for receiving liquid developer at least from the development electrode, and said receiver liquid developer being at least partially filtered by said filter means, the improvement comprising means for directing said received liquid to a free liquid volume portion of said developer tank, wherein said filter means comprises an open cell foraminous filter block having an average pore size greater than the size of particles in the liquid developer, and said pump means has an outlet for pumping liquid from said free liquid portion, under pressure, into said filter block.

2. In a development apparatus for visualizing a latent image on a photosensitive surface using a liquid developer, said apparatus having a development electrode, a developer tank containing a supply of liquid developer, a pump means for pumping liquid developer from the tank at least to the development electrode, a filter means positioned within the developer tank, means for mounting the developer tank for receiving liquid developer at least from the development electrode, and said received liquid developer being at least partially filtered by said filter means, the improvement comprising said filter means having an open cell foraminous filter block having an average pore size greater than the size of particles in the liquid developer, means for sealingly enclosing said filter block in said tank, and said pump means further comprising means for directing developer liquid, under pressure, to and from said filter, to said development electrode.

3. In a development apparatus for visualizing a latent image on a photosensitive surface using a liquid developer, said apparatus having a development electrode, a developer tank containing a supply of liquid developer, a pump means for pumping liquid developer from the tank at least to the development electrode, a filter means positioned within the developer tank, means for mounting the developer tank for receiving liquid developer at least from the development electrode, and said received liquid developer being at least partially filtered by said filter means, the improvement comprising said filter means having an open cell foraminous filter block having an average pore size greater than the size of particles in the liquid developer, means for sealingly enclosing said filter block in said tank, and said pump means further comprising means for directing developer liquid, under pressure, to and through said filter, to said development electrode, wherein said filter has a first and a second cut-away section for providing input and output manifolds.

4. A method for improving the density of development on a copy medium in a liquid developer photocopier, the photocopier having a development electrode, a developer tank containing asupply of liquid developer, a pump for pumping liquid developer from the developer tank to at least the development electrode, and a filter element positioned within the developer tank, the method comprising the steps of substantially sealing said filter in an enclosure having inlet and outlet openings;

pumping developer fluid into said filter under pressure, and filtering at least a portion of the liquid developer fluid in the the developer tank with a filter having openings much larger than the particles to be trapped, thereby reducing the particle mobility of the large particles relative to the general liquid mobility through the volume of the filter.

* * * * *